US005129299A

United States Patent [19]

Fischer et al.

[11] Patent Number: 5,129,299

[45] Date of Patent: Jul. 14, 1992

[54] DICING MACHINE

[75] Inventors: Robert R. Fischer, Michigan City; Gerald W. Urschel; Joe R. Urschel, both of Vaparaiso, all of Ind.

[73] Assignee: Urschel Laboratories Incorporated, Valparaiso, Ind.

[21] Appl. No.: 693,033

[22] Filed: Apr. 30, 1991

Related U.S. Application Data

[63] Continuation of Ser. No. 481,723, Feb. 16, 1990, abandoned, which is a continuation of Ser. No. 254,843, Oct. 7, 1988, abandoned.

[51] Int. Cl.[5] ..... B26D 1/62; B26D 3/22

[52] U.S. Cl. ..... 83/356.3; 83/121; 83/408; 83/422; 83/429; 83/435.2

[58] Field of Search ..... 83/404.1, 408, 422, 83/430, 436, 37, 44, 47, 168, 302, 121, 356.3

[56] References Cited

U.S. PATENT DOCUMENTS

| | | | |
|---|---|---|---|
| 918,427 | 4/1909 | Ellis | 83/429 |
| 1,975,261 | 10/1934 | Erickson | 83/404.1 |
| 2,138,262 | 11/1938 | Urschel et al. . | |
| 2,187,252 | 1/1940 | Urschel et al. . | |
| 2,242,557 | 5/1941 | Urschel et al. . | |
| 2,349,212 | 5/1944 | Urschel et al. . | |
| 2,436,410 | 2/1948 | Urschel et al. . | |
| 2,465,670 | 3/1949 | Urschel et al. . | |
| 2,541,180 | 2/1951 | Urschel et al. . | |
| 2,603,262 | 7/1952 | Urschel et al. . | |
| 2,934,117 | 4/1960 | Urschel et al. . | |
| 3,053,296 | 9/1962 | Urschel et al. . | |
| 3,217,988 | 11/1965 | Lightfeet et al. | 83/408 |
| 3,598,163 | 8/1971 | Urschel et al. | 83/408 |
| 3,847,045 | 11/1974 | Willhite, Jr. et al. | 83/37 |
| 4,207,787 | 6/1980 | Lewallyn | 83/408 |
| 4,782,729 | 11/1988 | Mathot | 83/408 |

*Primary Examiner*—Frank T. Yost
*Assistant Examiner*—Scott A. Smith
*Attorney, Agent, or Firm*—Bacon & Thomas

[57] ABSTRACT

A machine for cutting slabs of fresh or frozen tempered meat into diced sections and defined by a conveyor assembly comprised of a feed belt and an associated spring-biased feed roll, a strip cutting assembly comprised of a first knife roll of circular knives and an associated feed drum, and a crosscut assembly comprised of a second knife roll of elongate knives and an associated stripper plate provided with a corresponding shear edge, with edge portions of the circular knives being intermested within slots formed in the stripper plate and peripheral grooves formed in both the feed roll and feed drum. The feed drum is configured to retard the movement of fresh meat slabs being conveyed through the strip cutting assembly during which the circular knives are rotated at a peripheral speed that is at least twice the peripheral speed of the feed drum.

8 Claims, 5 Drawing Sheets

1
3
9
9
11
13
15
17
19
21
23
25
26
27

23
33
29
31
65
57
61
63
71
131
135
135
67
73
133
53
155
153
114
121
115
115
115
145
145
139
137
35
55
45
45
51
143
47
125
141

DICING MACHINE

This application is a continuation of application Ser. No. 97/481,723, filed Feb. 16, 1990, now abandoned, which is a continuation, of application Ser. No. 2564,843, filed Oct. 7, 1988, now abandoned.

BACKGROUND OF THE INVENTION

1. Field of the Invention

The present invention generally involves the field of technology pertaining to methods and apparatus for sectionalizing cuttable material into discrete particles of predetermined shape and size. More specifically, the invention relates to an improved machine for cutting a food product, particularly slabs of fresh or frozen tempered meat, into diced sections.

2. Description of the Prior Art

Machines for sectionalizing or dividing materials into smaller discrete portions through a series of cutting operations are well known in the art. Such machines are particularly suited for cutting food products, such as vegetables and fruits, into discrete pieces having a substantially rectangular or diced configuration. This is generally accomplished by conveying a large piece of the food product through a rotating bank of circular knives which initially cut the product into a plurality of elongate strips that are thereafter directed into a crosscut assembly wherein a rotating bank of elongate knives effect transverse cutting of the strips into diced sections. The bank of circular knives is associated with either a rotating feed drum or a stationary transfer plate, and defines a throat therebetween for receiving the conveyed product. The bank of elongate knives is provided with an associated stationary stripper plate having a cooperating shear edge against which the transverse cutting of the strips is accomplished.

Although conventional dicing machines have been proven effective for the dicing of certain food products, particularly vegetables, the use of such machines in the dicing of meat products have heretofore not been entirely satisfactory. For example, the dicing of fresh meat products is difficult due to the soft consistency of the meat which prevents effective cutting of same into strips by a bank of circular knives. Also, when a stationary plate is utilized in association with a bank of circular knives, portions of the meat which often contain adhesive substances are caused to adhere to the plate and thereby result in plugging of the machine. Another disadvantage is realized when a rotating feed drum is used in association with the circular knives since the drum tends to feed the product too quickly past the knives, thereby preventing the proper cutting of the product into strips.

Although the prior art does teach many different kinds of meat slicing and cutting machines either presently or potentially available for commercial use, there is still no known satisfactory machine capable of reliably and rapidly cutting slabs of both fresh and frozen tempered meat into strips, and thereafter cutting the strips into diced sections of consistent size and configuration. This is a significant deficiency since much of the commercially available meat is initially cut into the shape of slabs when removed from the animal carcass for subsequent processing.

SUMMARY OF THE INVENTION

It is an object of the present invention to provide an improved machine for sectionalizing cuttable material into discrete pieces of a desired size and configuration.

It is another object of the invention to provide an improved machine for efficiently and reliably producing diced sections of food products at high speeds.

It is a further object of the invention to provide an improved dicing machine that is particularly suited for producing discrete diced sections from slabs of fresh or frozen tempered meat.

It is still another object of the invention to provide an improved method for efficiently producing a diced meat product by first cutting a slab of meat into elongate strips and thereafter cutting the strips into discrete diced sections.

These and other objects of the invention are realized by providing a machine having a food product conveyor assembly comprised of a feed belt and an associated spring-biased feed roll for engaging and conveying the food product directly into the feed throat of a strip cutting assembly which cuts the food product into a plurality of strips. The strip cutting assembly is comprised of a first knife roll defined by a bank of longitudinally spaced circular knives and an associated feed drum. The resulting strips are conveyed directly from the strip cutting assembly to a crosscut assembly which transversely cuts the strips into a plurality of diced sections that are discharged through a chute. The crosscut assembly is comprised of a second knife roll defined by a bank of circumferentially spaced elongate knives and an associated stripper plate provided with a cooperating shear edge. Edge portions of the circular knives are intermeshed within a plurality of corresponding slots in the stripper plate and a plurality of corresponding peripheral grooves in both the feed roll and feed drum. The surface of the feed drum is configured to retard the movement of the food product through the strip cutting assembly in order to permit the bank of circular knives to perform their required cutting action when fresh meat is being cut into strips. The conveyor, strip cutting and crosscut assemblies are collectively driven through a pulley and gear assembly by an electric motor provided with an appropriate control system.

Other objects, features and advantages of the invention shall become apparent from the following detailed description of preferred embodiments thereof, when taken in conjunction with the drawings wherein like reference characters refer to corresponding parts in the several views.

DETAILED DESCRIPTION OF THE PREFERRED EMBODIMENTS

Figure 1:
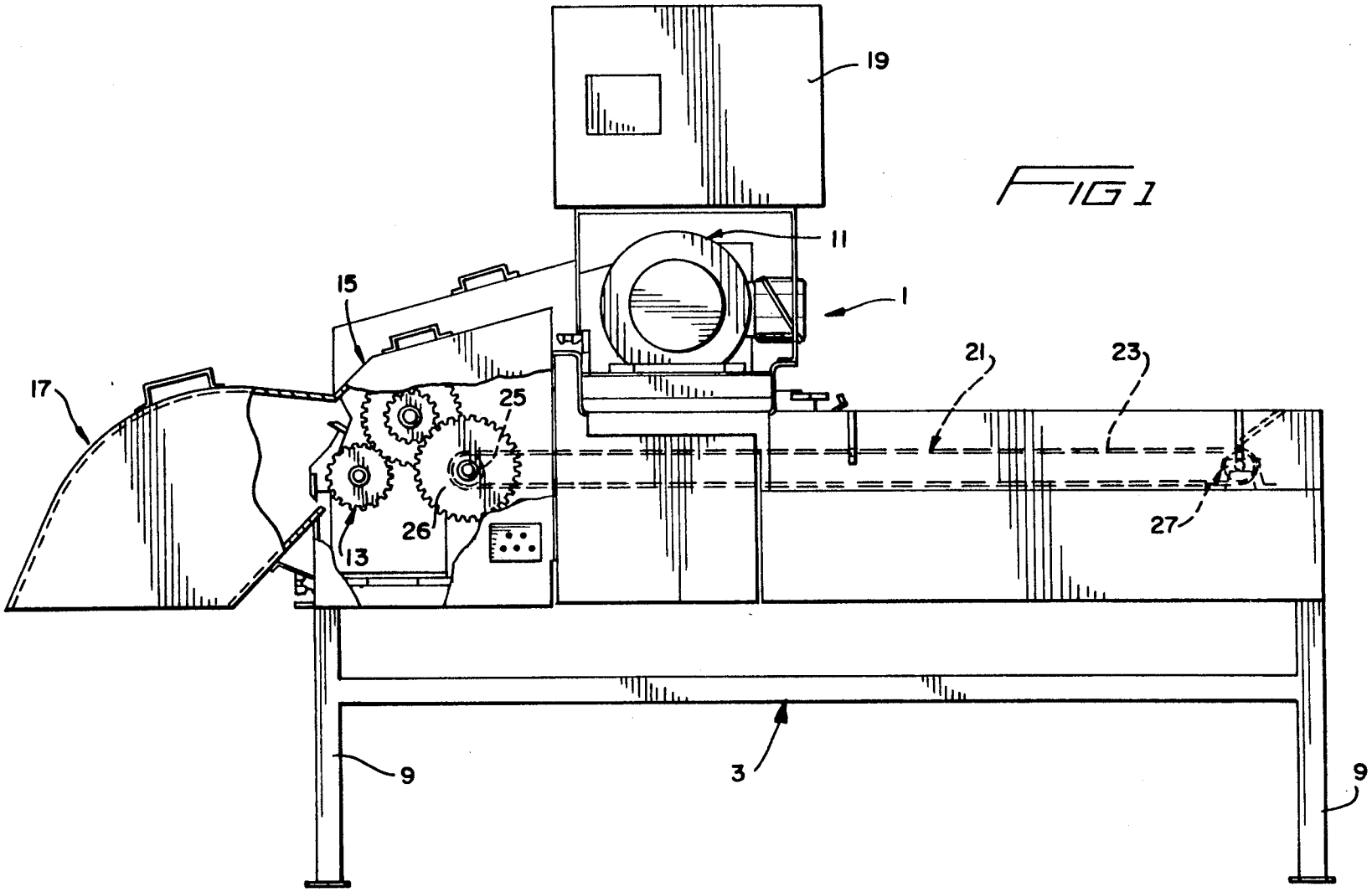
FIG. 1 is a front elevational view, partly in section, showing a preferred embodiment of a dicing machine according to the invention.

A dicing machine 1, according to a preferred embodiment of the invention, shall now be described with initial reference to FIGS. 1 and 2. As shown therein, machine 1 is mounted on a rectangular-shaped support frame 3 by bolting a component support base 5 of machine 1 to a plurality of inwardly directed plates 7. Frame 3 includes a plurality of legs 9 sized to support machine 1 at a desired height. Frame 3 may be of any appropriate conventional design and is preferably formed from tubular or channel-shaped metal members welded or bolted together.

Machine 1 includes an electric motor 11 for driving a pulley and gear assembly 13 which rotates the corresponding drive shafts of all of the components in a manner to be hereinafter detailed. Pulley and gear assembly 13 and its associated components are housed within a hood assembly 15 which permits easy access to system 13 and its components for maintenance purposes. A discharge chute 17 extends outwardly from hood 15 and frame 3 for discharging diced product DP produced by machine 1. The operation of machine 1 may be controlled by an appropriate known electrical or electronic system housed in a control box 19, through which electrical power may be transmitted to motor 11 for driving pulley and gear assembly 13.

Machine 1 also includes a conveyor assembly 21 which comprises a horizontal feed belt 23 provided with a driven roll 25 and an idler roll 27. Roll 25 is driven by a gear 26 in a manner to be later described.

Figure 2:
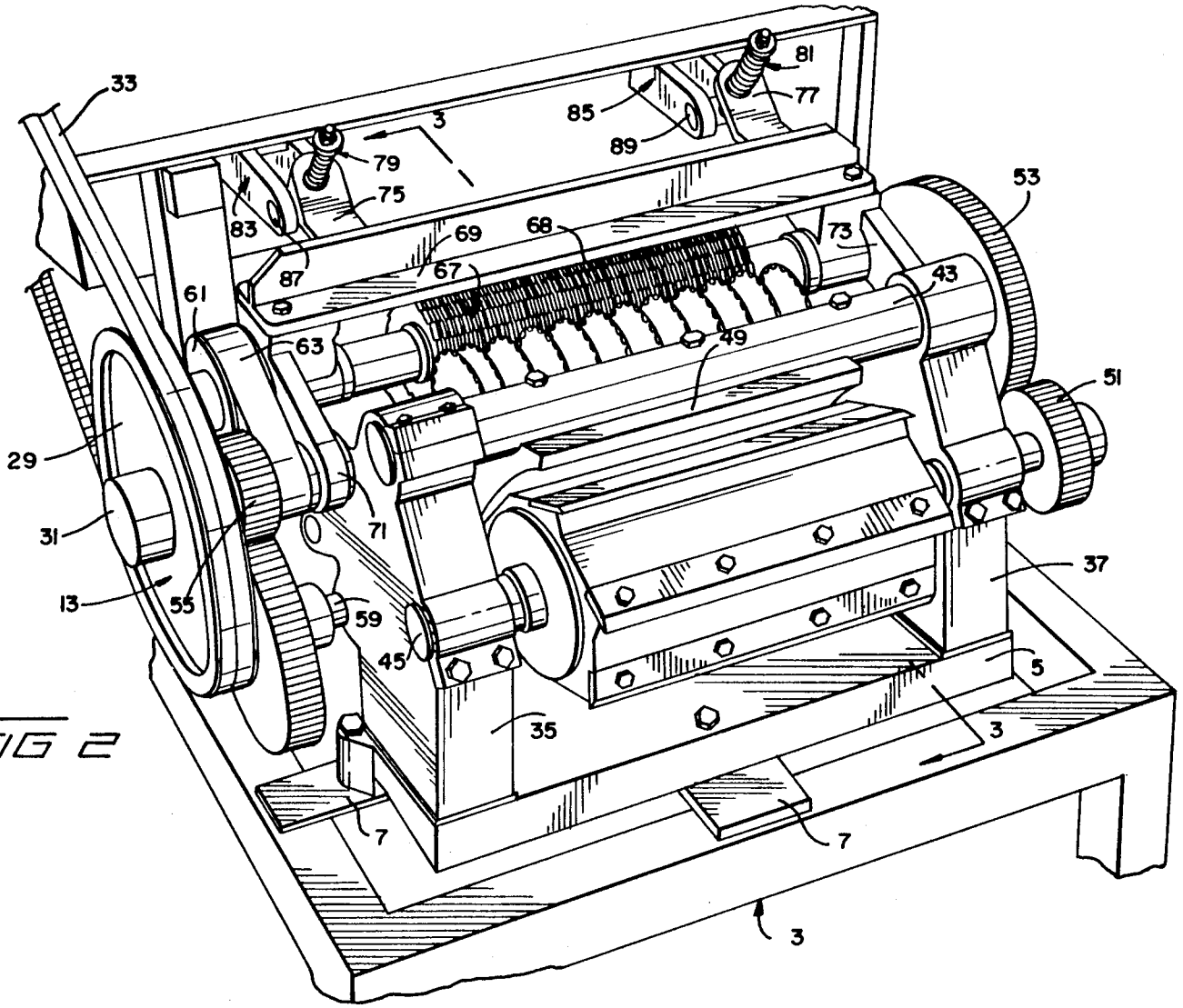
FIG. 2 is a partial perspective view of the machine shown in FIG. 1, with the discharge chute and hood assembly removed, and particularly depicting the feed roll, first knife roll, crosscut assembly, and pulley and gear assembly.

As shown in FIG. 2, system 13 includes a main drive pulley 29 mounted on a main drive shaft 31 which is rotated by the power output shaft of motor 11 through a main drive belt 33. System 13 is supported on a pair of spaced side frames 35 and 37 which extend vertically from support base 5. A crossbar 43 is clamped in side frames 35 and 37. A driveshaft 45 of a crosscut assembly 47 is supported in side frames 35 and 37. A stripper plate 49, forming a portion of crosscut assembly 47, is also bolted to crossbar 43. Drive shaft 45 of crosscut assembly 47 is provided with a gear 51 which is engaged with and driven by a larger gear 53 mounted on main drive shaft 31 opposite drive pulley 29. A main drive gear 55 is also mounted on drive shaft 31 inwardly of drive pulley 29 and is in driving engagement with a secondary drive gear 57 for rotating a drive shaft 59. Rotation of main drive shaft 31 also drives a secondary pulley 61 through a secondary drive belt 63 for rotating a drive shaft 65. A feed roll 67, forming a part of conveyor assembly 21, is supported for rotation on drive shaft 65, with the latter being supported at its opposite ends on a carrier frame 69. Roll 67 may be provided with a plurality of longitudinal grooves 68 spaced around its periphery for engaging food product P. A pair of brackets 71 and 73 extend forwardly of frame 69 and are journalled for pivotal movement about main drive shaft 31. The opposite side of carrier 69 is provided with a pair of rearwardly extending brackets 75 and 77 which are supported on a pair of spring loading assemblies 79 and 81, respectively. Assemblies 79 and 81 are attached to corresponding pairs of spaced lugs 83 and 85 for pivotal movement about a pair of support shafts 87 and 89, respectively.

Figure 3:
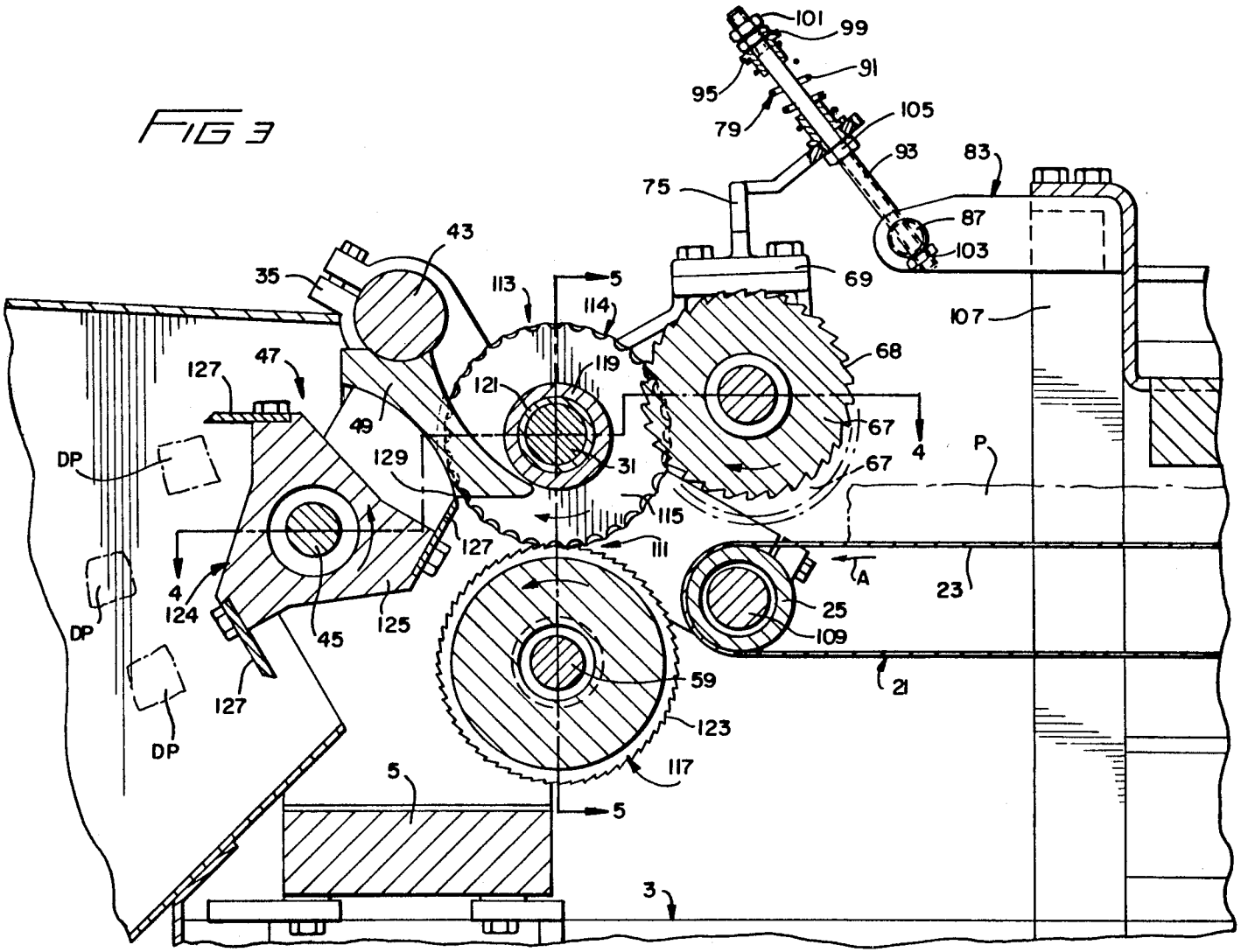
FIG. 3 is a cross-sectional view taken along the line 3—3 of FIG. 2.

With reference to FIG. 3, feed roll 67 is supported in a floating manner by carrier 69 and biased downwardly towards the upper flight of feed belt 23 and directly above driven roll 25 by spring loading assembly 79. The bias imparted to roller 67 is realized by means of a coil spring 91 supported on a shaft 93 between a pair of opposed follower sleeves 95 and 97. The outer end of shaft 93 is threaded to receive an adjustment nut 99 for compressing or expanding spring 91 to vary the degree of bias, and a lock nut 101 for maintaining the bias adjustment. The other end of shaft 93 is secured to shaft 87 by a nut 103 for pivotal movement about lugs 83. A nut 105 is provided on shaft 93 for engagement by bracket 75 to establish the vertical position of roll 67 with respect to belt 23 and driven roll 25. Lugs 83 are rigidly secured to an upright 107 carried by support frame 3. Another upright (not shown) is provided for supporting lugs 85 in the same manner, and spring loading assembly 81 has the same structure and function as that described for assembly 79. It is thus apparent that assemblies 79 and 81 may be adjusted to secure the desired degree of spring loading imparted to carrier 69 so that feed roll 67 shall be permitted to realize a corresponding degree of resiliency when a food product P is engaged between feed roll 67 and driven roll 25 while it is being conveyed on belt 23 in the direction indicated by arrow A. Feed roll 67 is rotated by shaft 65 in the indicated clockwise direction. Driven roll 25 is rotated in the indicated counterclockwise direction.

Immediately downstream from feed roll 67 and its associated feed belt 23 is a feed throat 111 of a strip cutting assembly 113 that includes a first knife roll 114 defined by a plurality of longitudinally spaced circular knives 115 supported on main drive shaft 31, and a feed drum 117 supported on drive shaft 59. Each knife 115 is separated from an adjacent knife 115 by an annular spacer ring 119, with knives 115 and rings 119 being carried on an arbor 121 supported on shaft 31. Feed drum 117 is provided with an outer circumferential surface 123 which is configured to retard the movement of food product P through throat 111 of assembly 113 for a purpose and in a manner to be later described.

Strips of food product P exiting strip cutting assembly 113 are conveyed directly to crosscut assembly 47. Assembly 47 includes a second knife roll 124 defined by a longitudinal block 125 supported on drive shaft 45 for rotation in the indicated counterclockwise direction. A plurality of elongate knives 127 are circumferentially spaced around block 125 for sequential cooperation with a shear edge 129 provided on stripper plate 49. Diced food product DP exiting from crosscut assembly 47 is discharged through chute 17.

The details of pulley and gear assembly 13 and the driving engagement thereof with corresponding driveshafts of driven roll 25, feed roll 67, strip cutting assembly 113 and crosscut assembly 47 shall now be described with reference to FIGS. 4 and 5. With initial reference to FIG. 4, it is seen that feed roll 67 is supported for rotation on drive shaft 65 which is in turn journalled through a pair of opposed bearings 131 and 133 carried by brackets 71 and 73, respectively. The circumferential surface of roll 67 is provided with a plurality of longitudinally spaced peripheral grooves 135. The spacings between grooves 135 correspond to the spacings between circular knives 115 so that edge portions of knives 115 are intermeshed within grooves 135. Drive shaft 31 of first knife roll 114 is journalled through a pair of bearings 137 and 139 carried by side frames 35 and 37, respectively. Longitudinal block 125 of crosscut assembly 47 is supported for rotation on drive shaft 45, the latter also being journalled through a pair of opposed bearings 141 and 143 carried by side frames 35 and 37, respectively. Stripper plate 49 is provided with a plurality of longitudinally spaced slots 145 therein. The spacings between slots 145 also correspond to those of knives 115 so that edge portions of knives 115 are intermeshed within slots 145. As therefore apparent from FIG. 4, knives 115 are intermeshed with feed roll 67 and stripper plate 49 during rotation of drive shafts 31, 45 and 65.

Figures 5, 6:
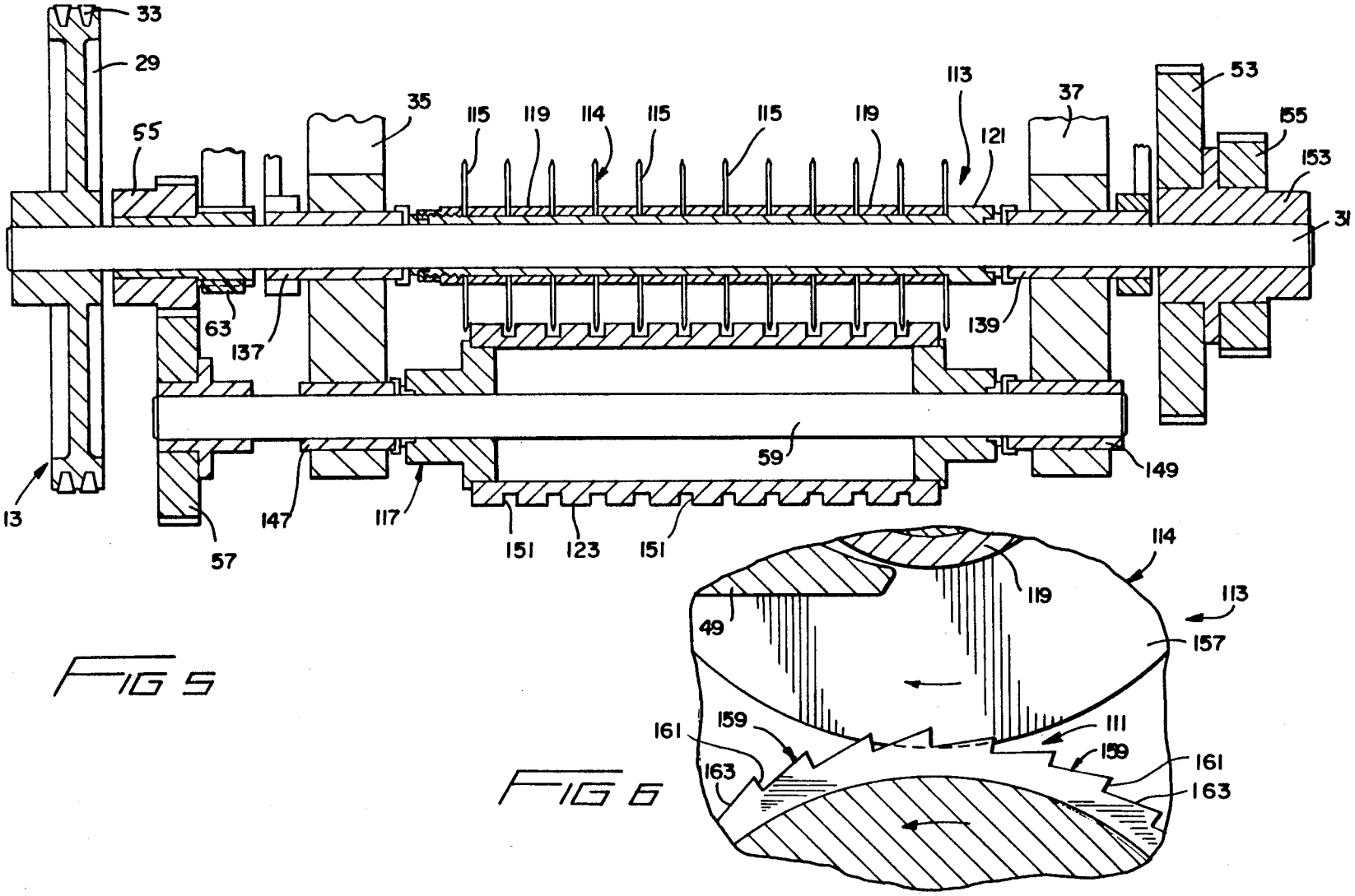
FIG. 5 is cross-sectional view taken along the line 5—5 of FIG. 3.
FIG. 6 is partial cross-sectional view of the strip cutting assembly, particularly depicting the first knife roll and retarding means on the peripheral surface of the associated feed drum.

With reference to FIG. 5, feed drum 117 of strip cutting assembly 113 is supported for rotation on drive shaft 59, the latter being journalled in a pair of opposed bearings 147 and 149 carried by side frames 35 and 37, respectively. The outer circumferential surface 123 of drum 117 is provided with a plurality of longitudinally spaced peripheral grooves 151, the spacings of which also correspond to those of knives 115 so that edge portions of knives 115 are intermeshed within grooves 151. Thus, knives 115 and feed drum 117 remain intermeshed during rotation about their respective driveshafts 31 and 59.

Figure 4:
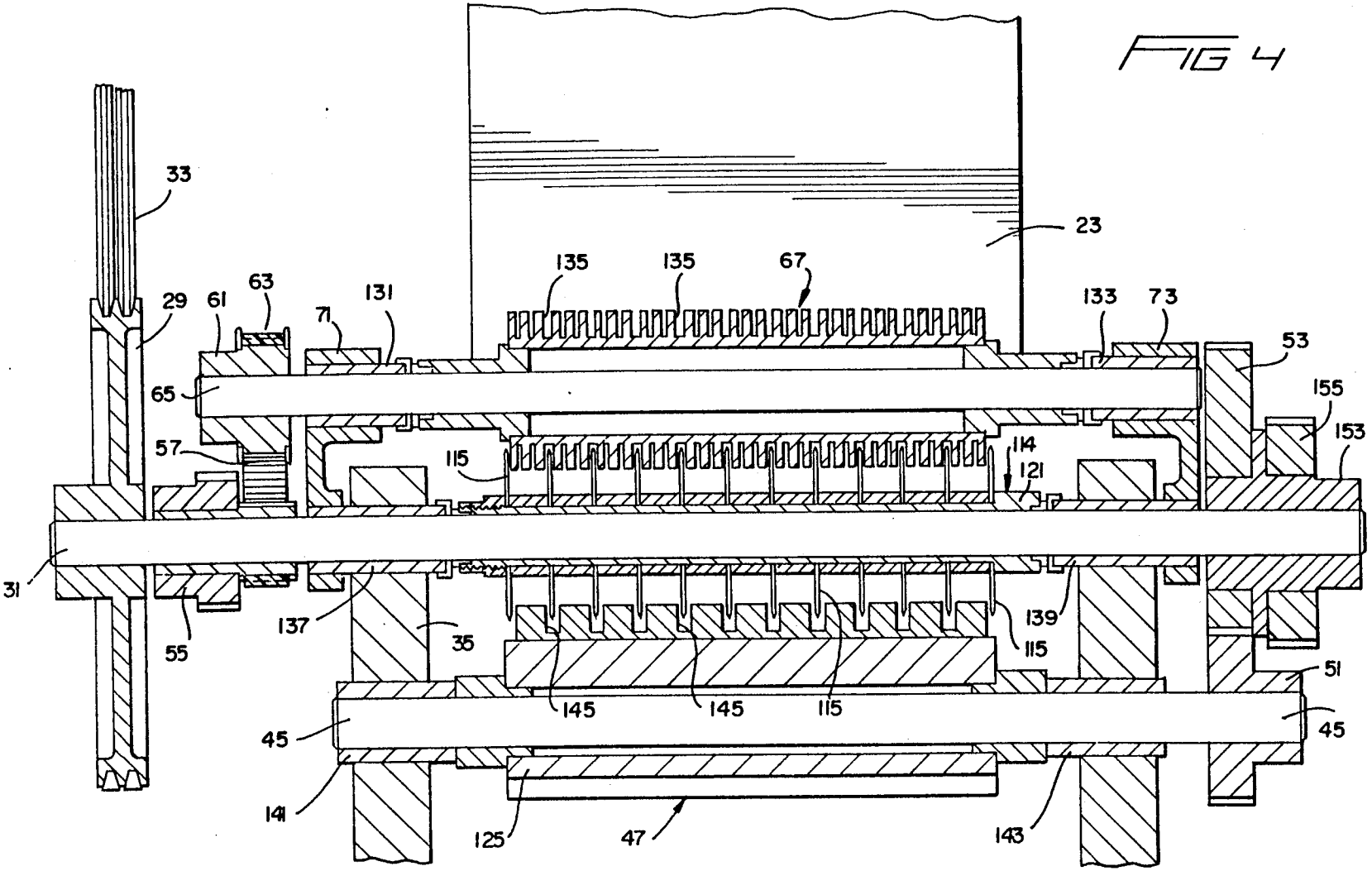
FIG. 4 is a cross-sectional view taken along the line 4—4 of FIG. 3.

As also shown in FIGS. 4 and 5, main driveshaft 31 is provided with a flanged sleeve 153 for supporting gear 53 and a smaller outer gear 155, the latter being disposed in driving engagement with gear 26 of driven roll 25 for driving feed belt 23 of conveyor assembly 21, as shown in FIG. 1.

Each circular knife 115 of first knife roll 114 may advantageously be provided with a serrated or scalloped peripheral cutting edge, as shown in FIG. 3. However, a plurality of circular knives 157 having plain cutting edges may also be advantageously utilized, as shown in FIG. 6. The choice of cutting edge configuration may be determined in accordance with the nature and consistency of food product P being cut by knife roll 114.

As also shown in FIG. 6, circumferential surface 123 of feed drum 117, in addition to being provided with peripheral grooves 151, is also configured to define a plurality of longitudinally extending and circumferentially spaced grooves 159. Each groove 159 is defined by a radial face 161 and a corresponding tangential face 163. In the indicated counterclockwise direction of rotation of drum 117, faces 161 are directed rearwardly of the direction of food product P travel through feed throat 111 of assembly 113. In this way, faces 161 serve to engage and retard the movement of product P through throat 111 during the cutting thereof, a procedure determined to be highly advantageous during the cutting of fresh meat due to its soft consistency. This retarding effect permits knives 115 or 157 to impart the appropriate slicing action on slabs of fresh meat, particularly when rotated at a peripheral speed that is at least twice the peripheral speed of feed drum 117. It is, of course, understood that the described configuration of surface 123 is preferred for the practice of the invention, and that other configurations are possible so long as such configurations serve the desired function of retarding the movement of food product P through throat 111 of assembly 113.

Variations in the relative peripheral speeds of feed roll 67, first and second knife rolls 114 and 124, feed drum 117, feed roll 67 and driven roll 25 of conveyor assembly 21 are realized by varying the ratios of the gearing rotating the respective drive shafts through appropriate substitution and replacement of the gears forming pulley and gear system 13.

MODE OF OPERATION

The manner in which machine 1 is utilized in dicing food product P shall now be described with reference to the figures, particularly FIG. 3.

The degree of spring bias imparted to feed roll 67 by spring loading assembly 79 and vertical position of roll 67 relative to driven roll 25 is established in accordance with the thickness and consistency of food product P and to compensate for occasional oversize pieces of product P moving between feed roll 67 and driven roll 25.

When machine 1 is placed in a mode of operation, motor 11 drives pulley and gear assembly 13, thereby imparting rotation in the indicated directions of driven roll 25, feed roll 67, first knife roll 114, feed drum 117 and second knife roll 124 of crosscut assembly 47.

Product P exiting from between feed roll 67 and drive roll 25 in the direction indicated by arrow A is directly and horizontally transferred to feed throat 111 of strip cutting assembly 113 and is cut into plural strips by first knife roll 114 intermeshed with feed drum 117, the width of the strips corresponding to the spacings between circular knives 115. As indicated in FIG. 3, knife roll 114 is rotated by main drive shaft 31 in a clockwise direction, while associated feed drum 117 is rotated in a counterclockwise direction. Strips of product P exiting assembly 113 are conveyed to crosscut assembly 47 wherein blades 127 effect transverse cuts of the strips against shear edge 129 of stripper plate 49. This produces diced sections DP of product P, which sections DP are then discharged through chute 17.

The spring-biased feed roll 67 in combination with the intermeshed disposition of first knife roll 14 within feed roll 67, feed drum 117 and stripper plate 49, collectively contribute to a high speed and reliable dicing of product P by machine 1 in a manner that cannot be duplicated by conventional dicing machines.

The nature of machine 1 renders it particularly advantageous for the dicing of fresh, cooked or frozen tempered slabs of meat. When it is desired to dice slabs of fresh meat, pulley and gear assembly 13 is configured so that feed roll 67 will rotate at a peripheral speed that is approximately the same speed as feed belt 23. Feed drum 117 of assembly 113 is rotated at approximately the same peripheral speed as meat product P being conveyed by roll 67 and belt 23. However, first knife roll 114 is rotated at a peripheral speed that is at least twice the peripheral speed of feed drum 117. This minimum difference in peripheral speeds was found to produce a continuous slicing action on fresh meat. Since fresh meat has a soft consistency, the rapid rotation of circular knives 115 tends to move meat product P too quickly through assembly 113. In order to realize a proper cutting action of meat product P into the desired strips, feed drum 117 is therefore provided with the circumferential surface 123 configuration depicted in FIG. 6 to retard the movement of meat product P being conveyed through feed throat 111 of assembly 113, thus allowing knives 115 to perform the required slicing action on meat product P. The cut strips of meat product P are then directed to crosscut assembly 47 for transverse cutting to produce diced sections DP therefrom.

When it is desired to dice slabs of cooked or frozen tempered meat, pulley and gear assembly 13 is adjusted to rotate first knife roll 114 at a peripheral speed that is only slightly faster than the peripheral speed of feed drum 117. The smaller variation between the peripheral speeds of blades 115 and drum 117 is possible because cooked or frozen tempered slabs of meat have a harder consistency than fresh meat.

It is to be understood that the forms of the invention herein shown and described are to be taken as preferred embodiments thereof, and various changes in shape, material, size and arrangements of parts may be resorted to without departing from the spirit of the invention or scope of the subjoined claims.

We claim:

1. Apparatus for cutting a product into diced sections comprising:

a) a rotatable first knife roll having a plurality of spaced apart, generally circular knives extending across a product feed path for cutting the product into a plurality of strips;

b) a rotatable feed drum extending generally parallel to the fist knife roll and defining therewith a feed throat, the rotatable feed drum having a peripheral surface defining a plurality of longitudinal grooves extending generally across the product feed path adapted to contact the product so as to control the speed of the product through the feed throat, each of the longitudinal grooves being defined by a generally radially extending face and a generally longitudinally extending face, wherein the generally radially extending face faces in a direction generally opposite to the direction of rotation of the feed drum;

c) a conveyor assembly including a driven, generally horizontal feed belt for supporting and conveying the product, the conveyor assembly defining an exit end;

d) a rotatable feed roll positioned near the exit end of the feed belt, the rotatable feed roll and the feed belt adapted to engage and convey the food product directly into the feed throat;

e) biasing means operatively associated with the feed roll to resiliently bias the feed roll against the product on the feed belt.

f) a crosscut assembly including a second knife roll having a plurality of elongate knifes extending generally across the product feed path;

g) a stripper plate defining a shear edge, the stripper plate being operatively associated with the first knife roll to remove the product from between the spaced knives after the product has been cut into a plurality of strips and operatively associated with the second knife roll such that the elongate knives cooperate with the shear edge to cut the product strips into diced sections; and, h) drive means operatively associated with the first knife roll, the feed drum, the feed roll and the second knife roll so as to rotate the first knife roll, the feed drum, the feed roll and the second knife roll.

2. The apparatus of claim 1 wherein the plurality of longitudinal grooves are circumferentially spaced about the periphery of the feed drum.

3. The apparatus of claim 1 wherein the drive means rotates the first knife roll and feed drum in opposite directions.

4. The apparatus of claim 1 wherein the drive means rotates the first knife roll at a peripheral speed of at least approximately twice the peripheral speed of the feed drum.

5. The apparatus of claim 1 wherein each of the generally circular knives has a scalloped cutting edge.

6. The apparatus of claim 1 wherein the biasing means comprises spring means operatively associated with the feed roll.

7. The apparatus of claim 6 further comprising means to adjust the biasing force of the spring means.

8. The apparatus of claim 1 wherein the conveyor assembly comprises a driven roll and an idler roll for driving the feed belt, the driven roll being disposed at an exit end of the feed belt substantially below the feed roll.

* * * * *